US007353959B2

(12) United States Patent
Zakula, Sr. et al.

(10) Patent No.: US 7,353,959 B2
(45) Date of Patent: Apr. 8, 2008

(54) VARIABLE-SPEED LOAD-DEPENDENT DRIVE AND HOIST SYSTEM

(75) Inventors: Daniel Brian Zakula, Sr., Mokena, IL (US); Myron Glickman, Arlington Heights, IL (US)

(73) Assignee: Mi-Jack Products, Inc., Hazel Crest, IL (US)

( * ) Notice: Subject to any disclaimer, the term of this patent is extended or adjusted under 35 U.S.C. 154(b) by 280 days.

(21) Appl. No.: 11/196,137

(22) Filed: Aug. 3, 2005

(65) Prior Publication Data

US 2006/0102578 A1 May 18, 2006

Related U.S. Application Data

(60) Provisional application No. 60/598,325, filed on Aug. 3, 2004.

(51) Int. Cl.
*B66C 13/16* (2006.01)

(52) U.S. Cl. ..... 212/278; 212/344; 212/345

(58) Field of Classification Search ..... 212/278, 212/344, 345

See application file for complete search history.

(56) References Cited

U.S. PATENT DOCUMENTS 3,504,556 A 4/1970 Mills
4,039,086 A * 8/1977 Ray ..... 212/278
5,893,471 A 4/1999 Zakula
5,937,646 A 8/1999 Zakula
6,081,292 A 6/2000 Lanigan, Jr. et al.
6,138,846 A 10/2000 Baumann
6,193,086 B1 2/2001 Gunnlaugsson et al.
6,527,130 B2 3/2003 Ruddy
6,644,486 B2 11/2003 Jacoff et al.
6,710,574 B2 * 3/2004 Davis et al. ..... 318/800
6,720,751 B2 * 4/2004 Plasz et al. ..... 318/567

FOREIGN PATENT DOCUMENTS

JP 6-199404 * 7/1994

* cited by examiner

*Primary Examiner*—Thomas J. Brahan
(74) *Attorney, Agent, or Firm*—Drinker Biddle & Reath LLP

(57) ABSTRACT

In an embodiment, a crane including a hoisting (i.e., load-lifting) mechanism is provided with a variable-speed load-dependent control system and method for operating functions of the crane. An exemplary control system includes an actuator subsystem for performing at least one function of the crane, a sensor for detecting the magnitude of the load lifted by the hoisting mechanism and a controller that communicates with the sensor, wherein, relative to a load signal from the sensor, the controller transmits a speed signal to vary an operating speed of at least one actuator of the actuator subsystem.

32 Claims, 4 Drawing Sheets

VARIABLE-SPEED LOAD-DEPENDENT DRIVE AND HOIST SYSTEM

CROSS-REFERENCE TO RELATED PATENT APPLICATIONS

This patent application claims the benefit of U.S. Provisional Patent Application No. 60/598,325 filed Aug. 3, 2004.

TECHNICAL FIELD

This invention generally pertains to a drive and hoist system and more particularly to a method and system for controlling the speed of an actuator in a drive and hoist system depending on the magnitude of a hoisted load.

BACKGROUND

Overhead cranes such as, for example, gantry and industrial cranes, are generally known for lifting heavy items weighing up to several hundred tons. Such cranes are often used for handling large products or containers and transporting them between storage locations and transportation such as ships, trains, trucks, etc. These cranes are commonly used in the construction industry as well, handling large construction materials, such as beams, blocks, concrete barriers, pipeline sections, prefabricated components, etc.

Conventional overhead cranes usually include two parallel horizontal beams that are elevated above a support (e.g., a frame made of horizontal and vertical members). Each of these horizontal beams is equipped with a trolley that is movable along the horizontal beam. Furthermore, each trolley includes a hoist for lifting and lowering a load. The hoist includes a cable, which depends downwardly from the trolley, and a hook block or the like that is suspended by the cable. For moving the entire crane, the support frame may include drivable and steerable wheels so that an operator can drive the crane over a job site to lift a load at one location and to deposit the load at a desired location.

In an attempt to ensure safety of site workers, prevent damage to a load being hoisted by the crane, and prevent damage to the crane itself (e.g., structural members, hydraulics, etc.), some cranes can be driven only at one relatively slow speed. However, such a configuration can be inefficient, particularly because a time to travel between two locations when the crane is in a loaded state (i.e., hoisting a load) is, disadvantageously, the same as a time to travel between two locations when the crane is in an unloaded state. Similarly, the trolleys and hoists of such foregoing cranes can only be operated, disadvantageously, at one speed. Thus, it takes an operator the same amount of time to raise the hoist and move the trolley when loaded as it does to raise the hoist and move the trolley when unloaded.

In an attempt to overcome these disadvantages, some cranes have been provided with a manually-operated control switch for varying the driving speed of the crane between a slow speed and a fast speed. However, as one can appreciate, a speed control of this sort is not ideal in some instances, for example, when the operator fails to select an optimal speed setting.

In view of the foregoing, a need exists for an improved control system and method for operating a crane.

BRIEF SUMMARY

In an embodiment, a crane including a hoisting (i.e., load-lifting) mechanism is provided with a variable-speed load-dependent control system and method for operating functions of the crane. An exemplary control system includes an actuator subsystem for performing at least one function of the crane, a sensor for detecting the magnitude of the load lifted by the hoisting mechanism and a controller that communicates with the sensor, wherein, relative to a load signal from the sensor, the controller transmits a speed signal to vary an operating speed of at least one actuator of the actuator subsystem. The actuator subsystem may include, for example, a drive subsystem that includes motors for driving and/or steering the crane and a hoist/trolley subsystem that includes motors hoisting a load and/or for moving a trolley. In an embodiment, the controller provides load-dependent control of both the drive and hoist/trolley subsystems.

In yet another embodiment, the controller causes the actuator subsystem to operate at a low speed or high torque when the magnitude of the lifted load is more than a predetermined threshold load and to operate at a high speed or low torque when the magnitude of the lifted load is less than the predetermined threshold load.

DETAILED DESCRIPTION

Figure 1:
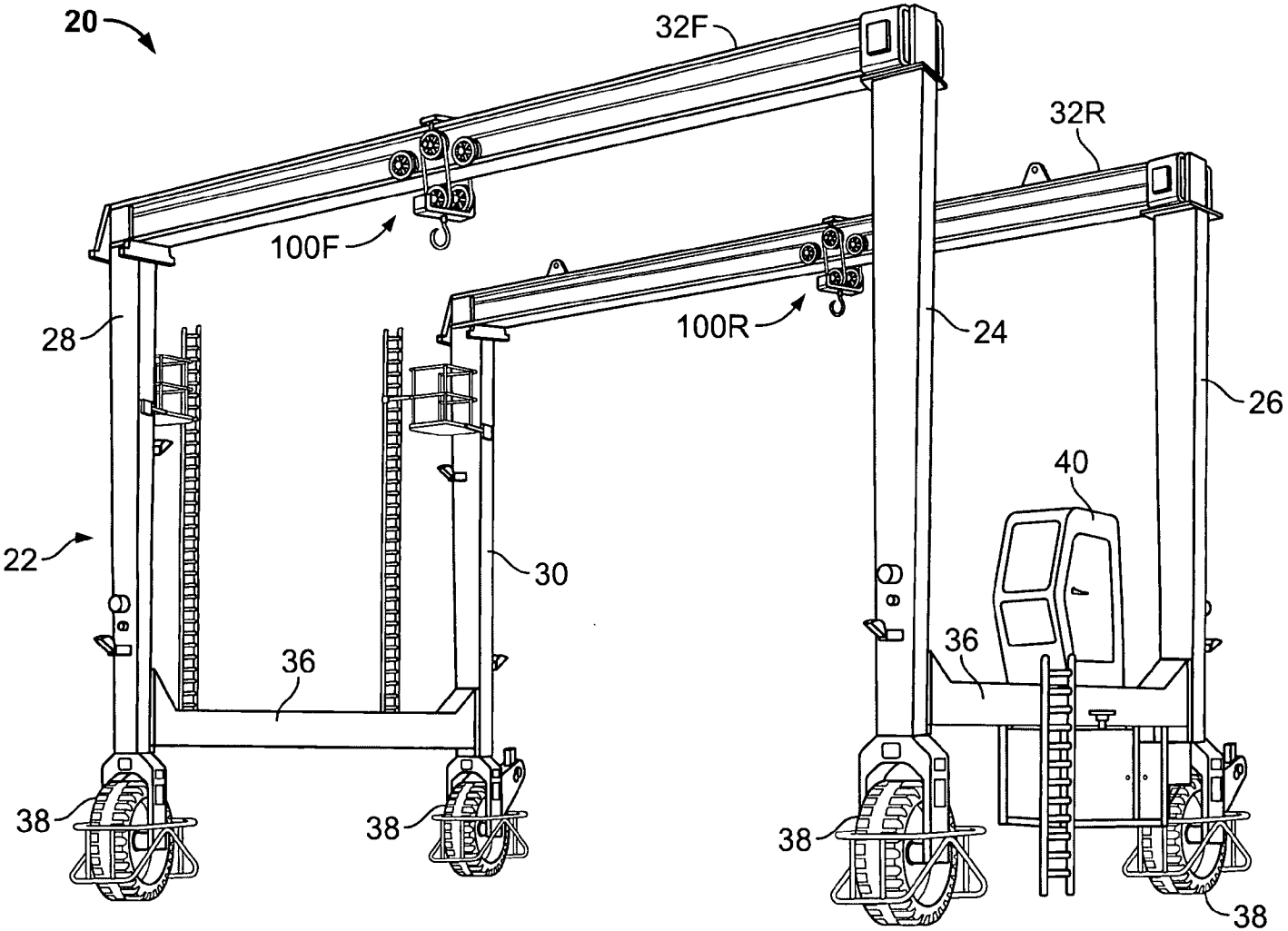
FIG. 1 is a perspective front view of an exemplary crane equipped with a control system for providing variable-speed load-dependent operation of various crane functions.

Referring now to the Figures, a system and method for controlling a drive and hoist system of a crane will be described. As shown in FIG. 1, an exemplary crane 20 is illustrated as including a support frame 22. The support frame 22 includes four corner-located vertical columns 24, 26, 28, and 30 that support front and rear transversely-mounted elevated horizontal members 32F and 32R, respectively. As shown, each of the front and rear horizontal members 32F, 32R includes a trolley mechanism 100F, 100R, respectively, for vertically and horizontally moving a load such as, for example, a shipping container. As known in the art, the horizontal members 32F and 32R may be beams (e.g., I-beams), channels or the like that include at least one flange. As can be appreciated from FIG. 1, exemplary horizontal members 32F, 32R are beams each of which including top and bottom flanges, but the members 32F, 32R may be beams including fewer or additional flanges. The trolley mechanisms 100F, 100R are each configured to guidably ride along the bottom flange and/or top flange to traverse the members 32F, 32R. Furthermore, for vertically lifting a load toward the horizontal members 32F, 32R, the trolley mechanisms 100F, 100R each include a hoist mechanism comprising a lifting cable that supports a hoist/hook block that engages with a load. Thus, for example, the illustrated trolley mechanisms 100F, 100R are movable along horizontal members 32F, 32R to position their hoist/hook blocks above a load that is to be picked up, after which the hoist/hook blocks are lowered, engaged with the load and raised. The trolley mechanisms 100F, 100R will be discussed hereafter in further detail with respect to FIG. 2. Although the illustrated crane 20 is illustrated as including hoist/hook blocks, in some embodiments, the mechanisms 100F, 100R may include a grappler apparatus or other lifting apparatus (e.g., a beam, strap, etc.) that is known in the art instead of or in addition to the illustrated hoist/hook blocks.

As further shown in FIG. 1, a wheel 38 is mounted under each of the columns 24, 26, 28, 30 for maneuvering the crane 20 over the ground. Two or more of the wheels 38 may be driven (e.g., the two front and/or the two rear wheels 38) by drive actuators such as hydraulic motors or the like. Two or more of the wheels 38 (e.g., the two front and/or the two rear wheels 38) may be turnable/steerable by actuators such as hydraulic cylinders or the like. The support frame 22 also includes a pair of side members 36 connected between respective columns in a front-to-back alignment at the right and left sides of the support frame 22. As shown, a cab 40 is located on one of the side members 36 of the support frame 22, but the cab 40 may be located elsewhere on the support frame 22. As is known, an operator can occupy the cab 40 for the purposes of driving/maneuvering the crane 20 and operating the trolley mechanisms 100F, 100R by way of operator input devices such as switches, buttons, foot pedals, joysticks or other devices known in the art.

Figure 2:
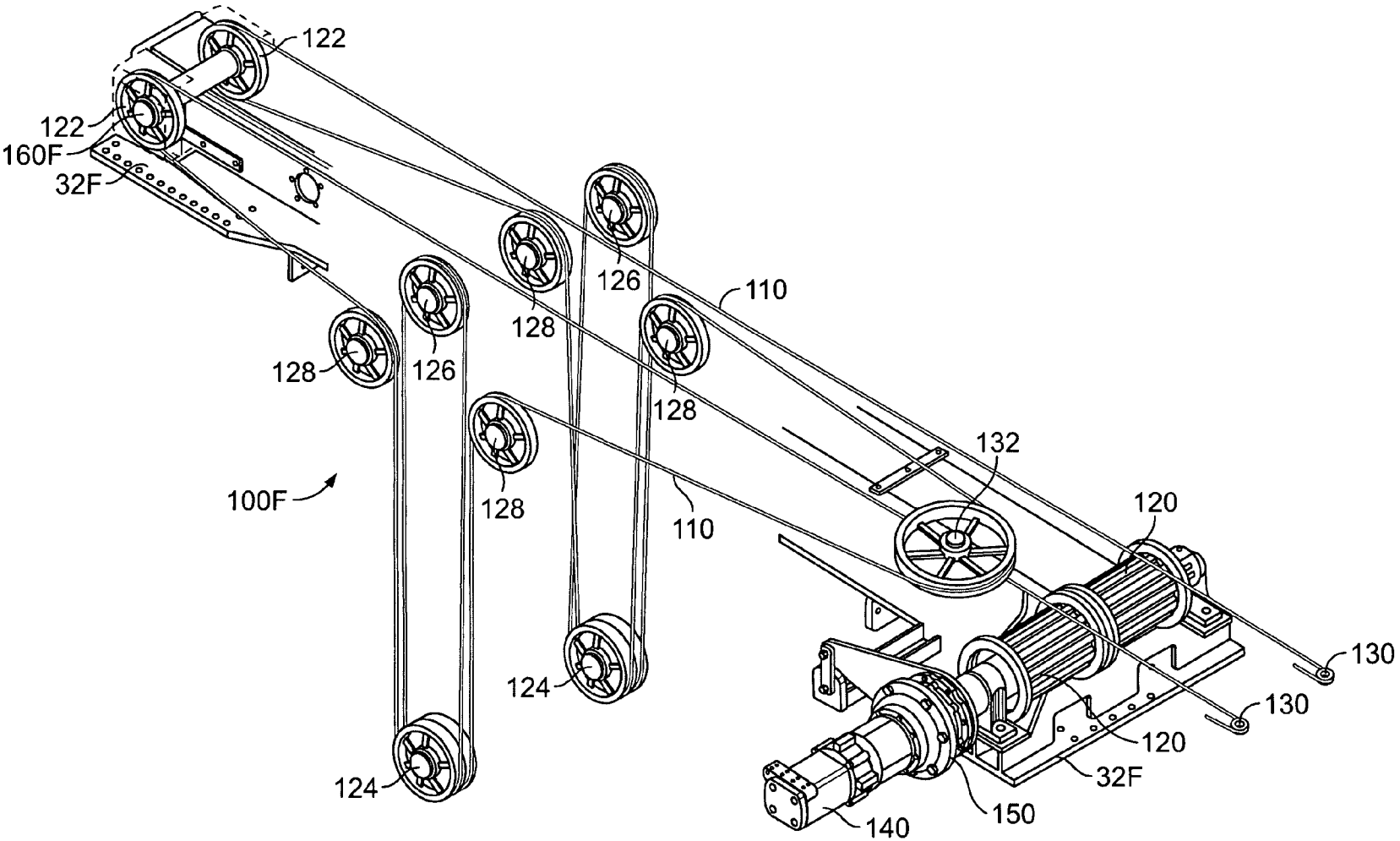
FIG. 2 is a perspective reeving diagram illustrating a portion of a hoist/trolley subsystem of the crane of FIG. 1.

Referring now to FIG. 2, the front trolley mechanism 100F of FIG. 1 is shown in a perspective, partial fragmentary view illustrating an example cable and pulley system. Although the rear trolley mechanism 100R of FIG. 1 is not shown in FIG. 2, one can appreciate that rear trolley mechanism 100R is substantially similar to the front trolley mechanism 100F. Furthermore, for clarity, certain elements of the front trolley mechanism 100F shown in FIG. 1 have been omitted from FIG. 2, such as the trolley drive system for moving the front trolley mechanism 100F along the horizontal member 32F. Although not illustrated herein, as known in the art, a trolley drive includes a trolley actuator such as a motor, a wire rope or cable and a plurality of pulleys or sheaves. One example trolley drive system is illustrated and described in U.S. Pat. No. 5,893,471 to Zakula for "Freely-Movable Auxiliary Hoist for a Gantry Crane and Method for Pivoting a Load", which is incorporated by reference herein in its entirety. As shown in FIG. 2, the trolley mechanism 100F includes a hoist cable 110 and a hoist drum 120. As shown, the hoist cable 110 is engaged with the hoist drum 120 by way of a wedge fitting 130, but other engagement means known in the art may be suitable as well. As can be appreciated, the hoist drum 120 is rotatably driven by an actuator such as a motor 140 or the like. In some embodiments, the actuator may operably shift between two outputs (e.g., a low speed and a high speed) to vary a rotational speed of the hoist drum 120. For example, the motor 140 may be a 700-series hydraulic motor available from the Parker Hannifin Corporation of Cleveland, Ohio that includes two separate power elements on a common shaft such that an integral selector valve switches the motor between high torque, low speed operation and high speed, low torque operation. Of course, other suitable hydraulic motors are of the variable-displacement type known in the art wherein the displacement of the motor is commanded from high displacement (high torque low speed) to low displacement (low torque high speed. Alternatively, the actuator output may be varied discretely or continuously by way of a control signal and/or a regulator (e.g., a governor), which may be provided for varying the operation of the actuator. As shown, an example regulator is gear box 150, but other regulators may be suitable as well. For example, in some embodiments employing a hydraulic motor for the motor 140, a hydraulic pump and/or a controlled valve such as a solenoid-actuated valve may adjust the hydraulic pressure, flow rate or the like to the hydraulic motor. Indeed, although the foregoing example actuator is the hydraulic motor 140, one can appreciate that the actuator may alternatively be any of a variety of suitable devices, for example, a hydraulic cylinder or an electric actuator such as an AC or DC motor.

As shown in FIG. 2, the main lifting cable 110 of trolley mechanism 100F is guided over a plurality of pulleys or sheaves. As illustrated, the plurality of sheaves includes an idler sheave 122 that is distal from the hoist drum 120, a hook/hoist block sheave 124, trolley sheaves 126 and crossover sheave 128, but other arrangements of sheaves may be suitable as well. As can be appreciated, the hoist drum 120 and idler sheave 122 are fixedly mounted to the horizontal member 32F for rotation about their respective horizontal axes. Crossover sheave 128 is fixedly mounted to the horizontal member 32F for rotation about its vertical axis. Trolley sheaves 126 and hoist/hook block sheaves 124 are movably translatable along the horizontal member 32F. As shown, the lifting cable 110 is reeved about the plurality of sheaves 122, 124, 126, 128 so that rotation of the hoist drum 120 by the motor 140 retracts and feeds the cable 110 thereby resulting in the raising and lowering of a hook/hoist block mounted on sheave 124.

According to one aspect of the subject system and method, each of the front and rear trolley mechanisms 100F, 100R is equipped with a sensor for sensing a load hoisted thereby. In one embodiment, the sensor may be a load cell or load-measuring pin that includes a strain gauge. As known in the art, a load-measuring pin (hereinafter referred to as load pin) senses the force applied to it via strain gauges installed within a small bore through the center of the pin and outputs a signal (e.g., a voltage) according to the applied force. In the illustrated embodiment, a load pin 160F is used to rotatably mount the idler sheave 122 and to sense a lifted load. It will be recognized that the load pin 160F could instead be mounted at other load-bearing locations of the front trolley mechanism 100F to detect a magnitude of a hoisted load as desired. For example, the load pin 160F may be used at the hoist/hook block sheave 124 and/or at one or more of the trolley sheaves 126 and crossover sheave 128. Furthermore, although not illustrated in FIG. 2, it can be appreciated that the rear trolley mechanism 100R (FIG. 1) is equipped with a sensor that may be similarly or differently configured. In one embodiment, the rear trolley mechanism 100R includes a load pin 160R that rotatably mounts one of a plurality of sheaves (e.g., a rear idler sheave similar to idler sheave 122). Moreover, alternatively, the sensor may be a pressure transducer, flow rate sensor or the like that is in fluid communication with a hydraulic motor as an embodiment of motor 140. As such, the sensor can detect changes in hydraulic pressure corresponding to a load that is lifted by the trolley mechanism 100F. Those skilled in the art will recognize that various types of sensors may be used and mated with various components in various ways to sense a lifted load.

Figure 3:
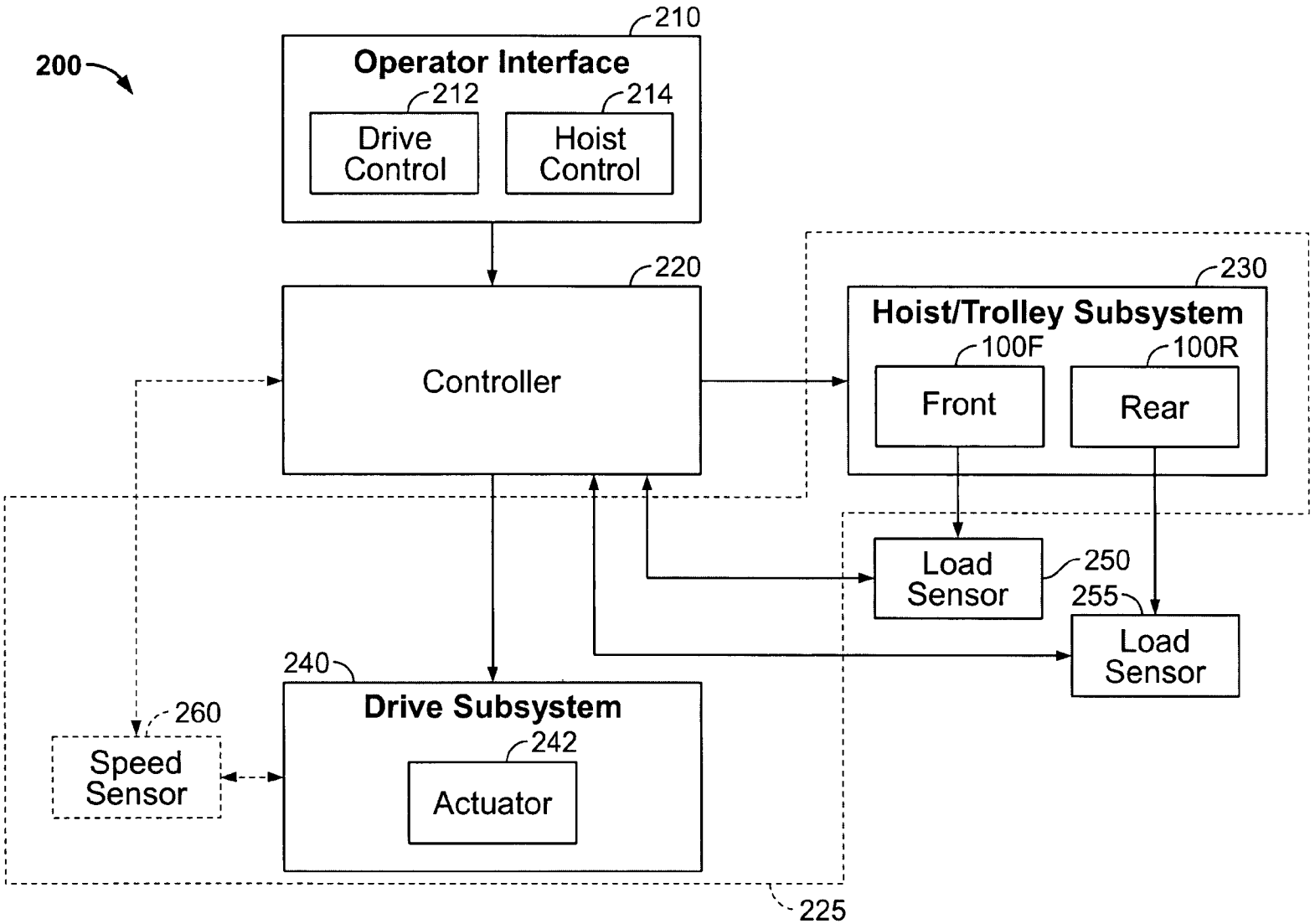
FIG. 3 is block diagram illustrating an example control system for the crane of FIG. 1.

Thus configured with a sensor for detecting a lifted load, a system for controlling a driving and hoisting system (e.g., a crane) are provided. Referring now to FIG. 3, a control system 200 for crane 20 of FIG. 1 is illustrated. As shown, the control system 200 includes an operator interface 210. As previously mentioned, the operator interface 210 is typically located in the cab 40 (FIG. 1) and is used by an operator for the purposes of driving/maneuvering the crane 20 and operating the hoist/trolley assemblies 100F, 100R. As shown, the operator interface 210 includes a drive control 212 for facilitating steering, driving or otherwise maneuvering of the crane and a hoist control 214 for moving each of the trolley mechanisms 100F, 100R along the horizontal members 32F, 32R and for operating a hoist mechanism in cooperation with the trolley mechanisms 100F, 100F. The drive and hoist controls 212, 214 may include any type of manually-operable controls such as, including but not limited to, switches, buttons, foot pedals, joysticks and other devices known in the art. The drive and hoist controls 212, 214 send drive and operational signals, respectively, to a controller 220.

The controller 220 may be a computer such as a commercially-available personal computer (PC) or a programmable logic device. The controller 220 may include a processor such as a microcomputer, microcontroller, microprocessor, programmable logic controller (PLC), field programmable gate array (FPGA) or state machine. As can be appreciated, the controller 220 receives a plurality of inputs, processes the inputs (for example, according to installed logic such as an executable software code running on a processor) and communicates outputs to various elements such as, including but not limited to, actuators and subsystems to operate the crane 20 (FIG. 1). Inputs to the controller 220 include signals from the operator interface 210 and sensor inputs relative to one or more states of elements and/or subsystems of the crane 20. Outputs from the controller 220 include control signals for changing an operating state (e.g., speed, torque, etc.) of an actuator, such as, including, but not limited to, motors, pumps, cylinders, valves, switches and relays. Control signals may be of any suitable analog or digital communication protocol, for example, pulse width modulation (PWM) type signals or the like.

In the illustrated embodiment, the controller 220 communicates with an actuator subsystem 225, which comprises at least a hoist/trolley subsystem 230 and a drive subsystem 240. As shown, the actuator subsystem 225 includes at least one actuator for operating various functions of the crane 20 (FIG. 1). Hoist/trolley subsystem 230 may include a plurality of actuators wherein, one actuator of the plurality is, for example, the motor 140 (FIG. 2) for operating a hoist function of each of the trolley mechanisms 100F, 100R (FIG. 1). Referring back to FIG. 2, the hoist/trolley subsystem 230 (FIG. 3) may include an actuator (not shown) for moving the hoist/hook sheave 124 and trolley sheaves 126 of trolley mechanisms 100F, 100R horizontally along the members 32F, 32R. Although not illustrated, it can be appreciated that the hoist/trolley system 230 may include a regulator for varying the operation of one or more of the plurality of actuators. For example, an electro-hydraulic pump, hydraulic power unit, electrically-controlled valve (e.g., solenoid valve) or the like may operate to vary the output of the motor 140, thereby operating the trolley mechanisms 100F, 100R at various speeds. As with the hoist/trolley subsystem 230, the drive subsystem 240 may include a plurality of actuators wherein, one actuator 242 of the plurality is, for example, a hydraulic motor for rotatably driving a wheel 38 (FIG. 1). Although not illustrated, it can be appreciated that, as with the hoist/trolley subsystem 230, the drive subsystem 240 may include a regulator for varying the operation of one or more of the plurality of actuators. For example, an electro-hydraulic pump, hydraulic power unit, electrically-controlled valve (e.g., solenoid valve) or the like may operate to vary the output of the wheel-rotating hydraulic motor, thereby rotating the wheel 38 at various speeds.

As further shown in FIG. 3, load sensors 250, 255 communicate with the actuator subsystem 225. In the illustrated embodiment of control system 200, although two load sensors 250, 255 are illustrated as communicating with the hoist/trolley subsystem 230, fewer or additional load sensors may be provided. The load sensors 250, 255 may each be, for example, load pins 160F, 160R that are used on each of the front and rear hoist/trolley assemblies 100F, 100R for detecting a magnitude of a hoisted load and for communicating a signal indicative of the magnitude of the load to the controller 220. In receipt of the signal from the load sensors 250, 255, the controller 220 may determine one or more of a suitable (e.g., safe and/or efficient) driving speed and a suitable trolley/hoist operating speed and output one or more control signals to the hoist/trolley subsystem 230 and the drive subsystem 240 to change a state of one or more of the plurality of actuators thereof. In one embodiment, one or more of the crane's functions are driven by hydraulic motors having two predetermined speeds, wherein the motors are switched between the two speeds by one or more trigger relays or the like. In another embodiment, one or more of the crane's functions are driven by hydraulic motors in conjunction with variable displacement hydraulic pumps that pump in a range from zero output to a maximum flow rate and/or by one or more proportional direction valves that change from a fully-closed state to a fully-open state or to one or more intermediate (i.e., partially open) states.

Now, relative to the signal outputs from the load sensors 250, 255 to the controller 220, the controller 220 processes the load sensor's output signals to determine if the load is greater than or less than a threshold load. Although two load sensors 250, 255 are provided, the controller 220 may process their outputs in a dependent manner (e.g., by summing) or separately/independently (e.g., by using OR logic), as known in the art. In one embodiment, if the controller 220 determines that the load is greater than a predetermined threshold value, the controller 220 outputs a signal to drive the crane 20 at low speeds. However, if the controller 220 determines that the load is less than the threshold value, the controller 220 outputs a signal to drive the crane 20 at a speed higher than the low speed. For example, a total load threshold for a crane may be one hundred thousand pounds and the controller 220 may look for either of the load sensors 250, 255 to output a signal relative to a force of greater than or equal to fifty thousand pounds (assuming a substantially similar front to back load distribution) before the controller 220 outputs a control signal for decreasing the operating speed of one or more of the plurality of actuators. Furthermore, the controller 220 may look for both of the load sensors 250, 255 to output a signal relative to a force of less than fifty thousand pounds (again, assuming a substantially similar front to back load distribution) before the controller 220 outputs a control signal for increasing the operating speed of one or more of the plurality of actuators. Of course, those skilled in the art will recognize that various types of control logic, algorithms and schemes may be employed by the controller 220. Furthermore, as can be appreciated, the controller 220 may be programmed to have separate and independent predetermined threshold values for switching or otherwise varying the operating speed of the hoist/trolley subsystem 230 and for switching or otherwise varying the driving speed of the drive subsystem 240, respectively. In other words, the controller is programmed to consider a first predetermined threshold associated with the driving subsystem and a second predetermined threshold associated with the hoisting subsystem.

In other embodiments, to further improve the operating efficiency of the crane 20, the controller 220 may process the signals received from the load sensors 250, 255 to provide more than two discretely or continuously-variable driving and/or operating speeds for the crane 20. For example, the controller 220 may execute a program or algorithm for calculating or otherwise determining a suitable driving and/or operating speed according to the load sensors' signals. For example, the controller 220 may determine suitable driving and/or operating speeds relative to a load-speed lookup table or the like.

As further shown in FIG. 3, the control system 200 may optionally include a speed sensor 260. As shown, the speed sensor 260 is in communication with the drive subsystem 240, but the speed sensor may alternatively or additionally communicate with the hoist/trolley subsystem 230. As can be appreciated, the speed sensor 260 may be an accelerometer, hydraulic flow rate sensor or the like that is configured for sensing at least one of a speed and acceleration of the entire crane 20 (e.g., a driving speed and acceleration) or a portion thereof (e.g., a trolley and/or hoist speed). As such, the speed sensor 260 outputs a speed signal to the controller 220 so that, in conjunction with sensing by the load sensors 250, 255, closed-loop feedback control of the crane 20 can be achieved. Thus, once the controller 200 detects a load via load sensors 250, 255 and outputs a speed-control signal to set a speed of one or more of the plurality of actuators in the actuator subsystem 225, the controller 220 can subsequently monitor and regulate the set speed according to an output from the speed sensor 260.

Figure 4:
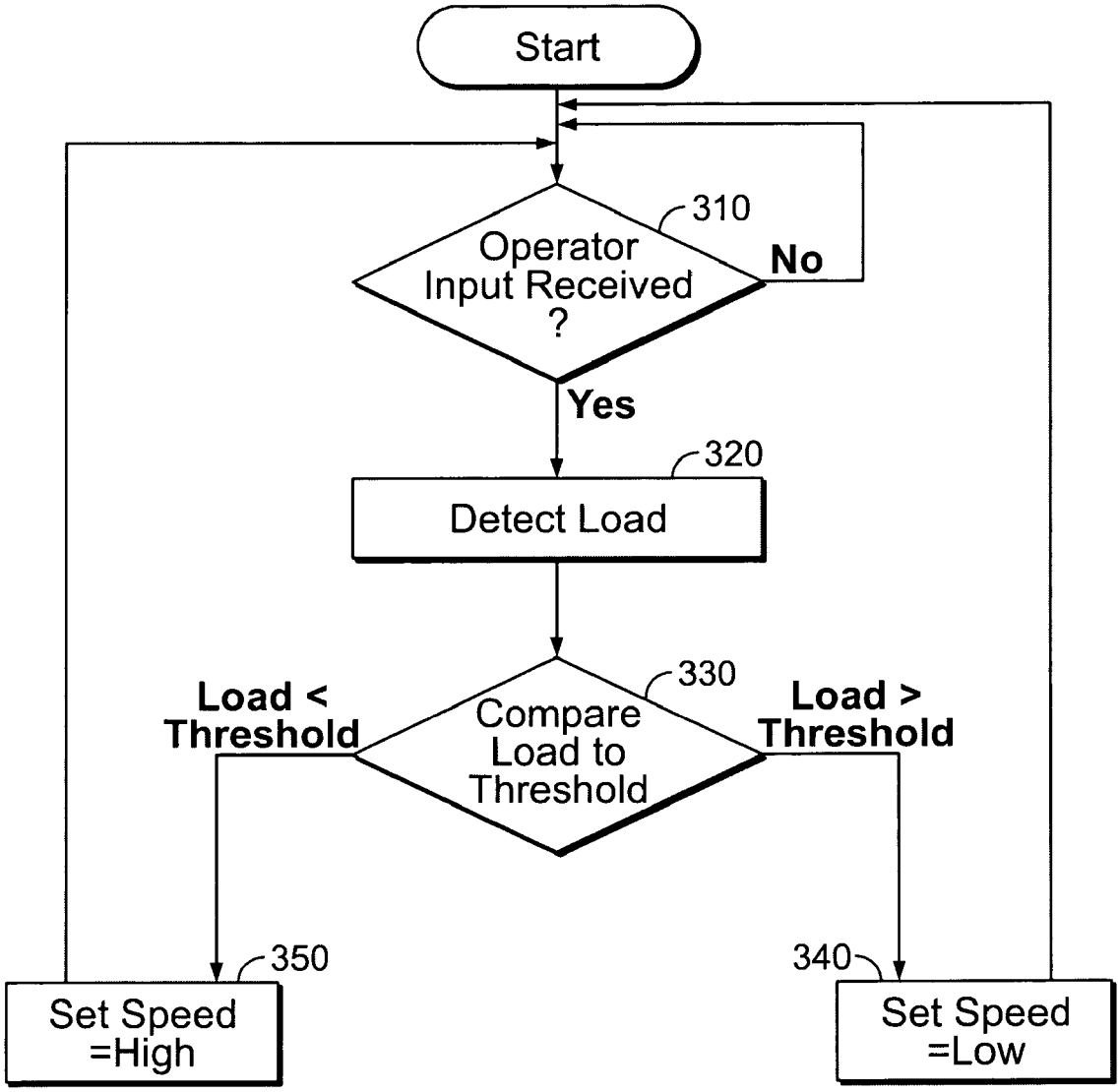
FIG. 4 is a flowchart illustrating an example method employed by the control system of FIG. 3.

Referring now to FIG. 4 a flowchart illustrates an exemplary method for controlling a driving and hoisting system (e.g., a crane) as would be processed by, for example, controller 220 described in connection with FIG. 3. In step 310, the controller determines if it has received an operator input (e.g., an operator command signal to drive, hoist, lower, etc. from one of the drive control 212 and the hoist control 214 of the operator interface 210 as described in FIG. 3). If the controller has not received an operator input, it can be appreciated that the control system is operating the crane in a steady state. If the controller determines that it has received an operator input in step 310, the controller proceeds to step 320. In step 320, the controller communicates with the load sensor (e.g., load pin 160 described with respect to FIG. 2) to detect if a load is presently being hoisted. In some embodiments, the load sensor 250 may be mounted such that it is subject to less than the entire magnitude of the hoisted load such as the embodiment illustrated in FIG. 2 wherein the load sensor is a load pin that detects the load on the associated sheave. In any case, the load sensor can be calibrated and/or the controller can be set to detect a load greater than a predetermined threshold value relative to the signal from the load sensor. Having communicated with the load sensor, the controller now in step 330 compares the sensed load with a threshold load, which may be programmed in the controller according to the configuration and use of the crane. If the controller determines that the sensed load is greater than the threshold load, in step 340, the controller sets one or more of an operating speed and a driving speed to be a low speed. Alternatively, if the controller determines that the sensed load is less than the threshold load, in step 350, the controller sets one or more of an operating speed and a driving speed to be a speed that is greater than the low speed. Thus operating efficiency of the crane is increased. Of course, as can be appreciated, steps 330-350 may be substituted with steps that provide for continuously-variable speed adjustment.

While the present invention has been illustrated by a description of various embodiments and while these embodiments have been set forth in considerable detail, it is intended that the scope of the invention be defined by the appended claims. It will be appreciated by those skilled in the art that modifications to the foregoing embodiments may be made without departing from the teachings of the present invention. It is deemed that the spirit and scope of the invention encompass such variations as would be apparent to one of ordinary skill in the art and familiar with the teachings of the present application.

What is claimed is:

1. A crane for lifting a load, the crane comprising:

a hoisting mechanism that includes a trolley mechanism at a front of the crane with a first load sensor and a trolley mechanism at a rear of the crane with a second load sensor;

an actuator subsystem including an actuator for moving at least one component of the crane;

a sensor for detecting a load lifted by the hoisting mechanism, the sensor providing a load signal indicating a magnitude of the load; and a controller in communication with the actuator subsystem and the sensor, wherein the controller varies a speed of the actuator by comparing the load signals from the respective first and second sensors to a predetermined threshold, causes the actuator to operate at a high speed if both of the load signals from the respective first and second sensors are lower than the predetermined threshold, and causes the actuator to operate at a low speed if either of the load signals from the respective first and second sensors is higher than the predetermined threshold.

2. The crane of claim 1, wherein the controller varies the speed of the actuator by comparing the load signal to a predetermined threshold, causes the actuator to operate at a high speed if the load signal is lower than the predetermined threshold, and causes the actuator to operate at a low speed if the load signal is higher than the predetermined threshold.

3. The crane of claim 1, wherein said component is the hoisting mechanism, and the actuator is a hoist actuator moving the hoisting mechanism.

4. The crane of claim 3, wherein the hoist actuator is a two-speed motor.

5. The crane of claim 1, wherein said component includes wheels for maneuvering the crane, and wherein the actuator comprises a drive actuator for rotatably driving at least one of the wheels.

6. The crane of claim 5, wherein the drive actuator is a two-speed motor.

7. The crane of claim 1, wherein the actuator subsystem comprises:

a hoist subsystem including a hoist actuator for operating the hoisting mechanism; and a drive subsystem including a drive actuator for rotatably driving a wheel.

8. The crane of claim 7, wherein the controller varies a drive speed of the drive actuator by comparing the load signal to a first predetermined threshold, causes the drive actuator to operate at a high drive speed if the load signal is lower than the first predetermined threshold, and causes the drive actuator to operate at a low drive speed if the load signal is higher than the first predetermined threshold, and wherein the controller varies a hoist speed of the hoist actuator by comparing the load signal to a second predetermined threshold, causes the hoist actuator to operate at a high hoist speed if the load signal is lower than the second predetermined threshold, and causes the hoist actuator to operate at a low hoist speed if the load signal is higher than the first predetermined threshold.

9. The crane of claim 7 wherein the hoist subsystem further comprises:

a plurality of hoisting sheaves; and a hoist cable reeved about the plurality of hoisting sheaves, wherein the hoist cable connected for movement by the hoist actuator.

10. The crane of claim 9 wherein the sensor is a load pin that supports at least one sheave of the plurality of hoisting sheaves.

11. The crane of claim 10 wherein the at least one sheave is an idler sheave, the idler sheave distal from a hoist drum that is rotatably driven by the hoist actuator.

12. The crane of claim 1 further comprising a speed sensor for detecting the speed of the actuator and providing a speed signal to the controller to establish closed loop detection of the actuator speed.

13. A crane including a hoisting mechanism for lifting a load, the crane comprising:

an actuator subsystem including an actuator for operating at least one function of the crane;

means for sensing a load lifted by the hoisting mechanism and detecting and indicating a magnitude of the load, said means for sensing including a first load sensor and a second load sensor, the hoisting mechanism comprising a trolley mechanism at a front of the crane to which the first load sensor is mounted, and a trolley mechanism at a rear of the crane to which the second load sensor is mounted, and wherein the controller varies the speed of the actuator by comparing the load signals from the respective first and second sensors to a predetermined threshold, causes the actuator to operate at a high speed if both of the load signals from the respective first and second sensors is lower than the predetermined threshold, and causes the actuator to operate at a low speed if either of the load signal from the respective first and second sensors is higher than the predetermined threshold; and means for controlling a speed of the actuator according to the magnitude of the load.

14. The crane of claim 13, wherein the means for controlling varies the speed of the actuator by comparing the load signal to a predetermined threshold, causes the actuator to operate at a high speed if the load signal is lower than the predetermined threshold, and causes the actuator to operate at a low speed if the load signal is higher than the predetermined threshold.

15. The crane of claim 13, wherein the actuator comprises a hoist actuator for operating the hoisting mechanism.

16. The crane of claim 15, wherein the hoist actuator is a two-speed motor.

17. The crane of claim 13, wherein the crane includes wheels for maneuvering the crane, and wherein the actuator comprises a drive actuator for rotatably driving at least one of the wheels.

18. The crane of claim 17, wherein the drive actuator is a two-speed motor.

19. The crane of claim 13, wherein the actuator subsystem comprises:

a hoist subsystem including a hoist actuator for operating the hoisting mechanism; and a drive subsystem including a drive actuator for rotatably driving a wheel.

20. The crane of claim 19, wherein the means for controlling varies a drive speed of the drive actuator by comparing the load signal to a first predetermined threshold, causes the drive actuator to operate at a high drive speed if the load signal is lower than the first predetermined threshold, and causes the drive actuator to operate at a low drive speed if the load signal is higher than the first predetermined threshold, and wherein the means for controlling varies a hoist speed of the hoist actuator by comparing the load signal to a second predetermined threshold, causes the hoist actuator to operate at a high hoist speed if the load signal is lower than the second predetermined threshold, and causes the hoist actuator to operate at a low hoist speed if the load signal is higher than the second predetermined threshold.

21. The crane of claim 19 wherein the hoist subsystem further comprises:

a plurality of hoisting sheaves; and a hoist cable reeved about the plurality of hoisting sheaves, wherein the hoist cable connected for movement by the hoist actuator.

22. The crane of claim 21 wherein the means for sensing is a load pin that supports at least one sheave of the plurality of hoisting sheaves.

23. The crane of claim 22 wherein the at least one sheave is an idler sheave, the idler sheave distal from a hoist drum that is rotatably driven by the hoist actuator.

24. A method for controlling a crane including a hoist mechanism for lifting a load, said hoisting mechanism having a trolley mechanism at a front of the crane and a trolley mechanism at a rear of the crane, and an actuator system having at least one actuator for moving at least one component of the crane, the method comprising:

receiving an operator input selecting to drive the at least one actuator;

detecting a load lifted by the trolley mechanism at the front of the crane and detecting a load lifted by the trolley mechanism at the rear of the crane;

determining if the load detected at either the front or rear trolley mechanisms exceeds a given threshold and a speed for the at least one actuator; and driving the at least one actuator at the speed determined in the determining step.

25. The method of claim 24, wherein the driving step comprises varying a control signal that is communicated to the actuator subsystem.

26. A crane including a hoisting mechanism for lifting a load, the crane comprising:

an actuator subsystem comprised of:

an actuator for moving at least one component of the crane;

a hoist subsystem including a hoist actuator for operating the hoisting mechanism; and a drive subsystem including a drive actuator for rotatably driving a wheel;

a sensor for detecting a load lifted by the hoisting mechanism, the sensor providing a load signal indicating a magnitude of the load; and a controller in communication with the actuator subsystem and the sensor, wherein the controller varies a drive speed of the drive actuator by comparing the load signal to a first predetermined threshold, causes the drive actuator to operate at a high drive speed if the load signal is lower than the first predetermined threshold, and causes the drive actuator to operate at a low drive speed if the load signal is higher than the first predetermined threshold, and wherein the controller varies a hoist speed of the hoist actuator by comparing the load signal to a second predetermined threshold, causes the hoist actuator to operate at a high hoist speed if the load signal is lower than the second predetermined threshold, and causes the hoist actuator to operate at a low hoist speed if the load signal is higher than the first predetermined threshold.

27. A crane including a hoisting mechanism for lifting a load, the crane comprising:

an actuator subsystem comprised of:

an actuator for moving at least one component of the crane;

a hoist subsystem comprised of:

a hoist actuator for operating the hoisting mechanism;

a plurality of sheaves; and a hoist cable reeved about the plurality of hoisting sheaves, wherein the hoist cable connected for movement by the hoist actuator;

a drive subsystem including a drive actuator for rotatably driving a wheel;

a sensor for detecting a load lifted by the hoisting mechanism, the sensor being a load pin that supports at least one sheave of the plurality of hoisting sheaves, the sensor providing a load signal indicating a magnitude of the load; and a controller in communication with the actuator subsystem and the sensor, wherein the controller varies a speed of the actuator as a function of the load signal.

28. The crane of claim 27 wherein the at least one sheave is an idler sheave, the idler sheave distal from a hoist drum that is rotatably driven by the hoist actuator.

29. A crane including a hoisting mechanism for lifting a load, the crane comprising:

an actuator subsystem comprised of an actuator for operating at least one function of the crane;

a hoist subsystem comprised of:

a hoist actuator for operating the hoisting mechanism;

a plurality of hoisting sheaves; and a hoist cable reeved about the plurality of hoisting sheaves, wherein the hoist cable connected for movement by the hoist actuator;

a drive subsystem including a drive actuator for rotatably driving a wheel;

means for sensing a load lifted by the hoisting mechanism and detecting indicating a magnitude of the load, wherein said means for sensing is a load pin that supports at least one sheave of the plurality of hoisting sheaves; and means for controlling a speed of the actuator according to the magnitude of the load.

30. The crane of claim 29 wherein the at least one sheave is an idler sheave, the idler sheave distal from a hoist drum that is rotatably driven by the hoist actuator.

31. A method for controlling a crane including a hoist mechanism for lifting a load and at least two actuator subsystem having at least one actuator for moving at least one component of the crane, wherein one of the actuator subsystems is a hoisting subsystem in which the actuator is a hoist actuator and the component is the hoist mechanism, and wherein the other actuator subsystem includes a driving subsystem in which the actuator is a drive actuator and the component is at least one wheel of the crane, whereby the determining step includes determining if the load is greater than a first predetermined threshold associated with the driving subsystem and determining if the load is greater than a second predetermined threshold associated with the hoisting subsystem, the method comprising:

receiving an operator input selecting to drive the at least one actuator;

detecting a load lifted by the hoisting mechanism; and determining a speed for the at least one actuator a function of the detecting step; and driving the at least one actuator at the speed determined in the determining step.

32. The method of claim 31, whereby the driving step includes driving the drive actuator at a high drive speed if the load is less than the first predetermined threshold, driving the drive actuator at a low drive speed if the load exceeds the first predetermined threshold, driving the hoist actuator at a high hoist speed if the load is less than the second predetermined threshold, and driving the hoist actuator at a low hoist speed if the load exceeds the second predetermined threshold.

* * * * *